US005098004A

United States Patent [19]

Kerrigan

[11] Patent Number: 5,098,004

[45] Date of Patent: Mar. 24, 1992

[54] FASTENER DRIVING TOOL

[75] Inventor: James E. Kerrigan, Des Plaines, Ill.

[73] Assignee: Duo-Fast Corporation, Franklin Park, Ill.

[21] Appl. No.: 620,371

[22] Filed: Dec. 5, 1990

Related U.S. Application Data

[63] Continuation-in-part of Ser. No. 453,819, Dec. 19, 1989, abandoned.

[51] Int. Cl.[5] ..... B25C 1/06

[52] U.S. Cl. ..... 227/134; 227/131; 173/13; 173/53; 173/121

[58] Field of Search ..... 227/131, 132, 134, 133, 227/8; 173/121, 13, 53

[56] References Cited

U.S. PATENT DOCUMENTS

| | | | |
|---|---|---|---|
| 4,042,036 | 8/1977 | Smith et al. | 227/131 X |
| 4,298,072 | 11/1981 | Baker et al. | 227/131 X |
| 4,323,127 | 4/1982 | Cunningham | 227/131 X |
| 4,349,143 | 9/1982 | Ewig | 227/134 X |
| 4,544,090 | 10/1985 | Warman et al. | 227/134 X |
| 4,721,170 | 1/1988 | Rees | 173/121 X |
| 4,928,868 | 5/1990 | Kerrigan | 227/131 |
| 4,964,558 | 10/1990 | Crutcher et al. | 227/131 X |

*Primary Examiner*—Frank T. Yost
*Assistant Examiner*—Rinaldi Rada
*Attorney, Agent, or Firm*—Mason, Kolehmainen, Rathburn & Wyss

[57] ABSTRACT

A lightweight fastener driving tool capable of being battery powered utilizes a low cost fastener driving ram or blade that is normally located in a nip defined between a motor driven flywheel and an idler wheel. Upon the actuation of a trigger operated timing circuit, a solenoid is energized. The solenoid controls a toggle mechanism to adjust the position of the idler wheel with respect to the flywheel so as to force the blade against the flywheel and thereby to close the nip for a sufficient amount of time to initiate the driving of the blade downwardly through the nip. The timing circuit deenergizes the solenoid prior to the time that the blade exits the nip but the toggle mechanism maintains the idler wheel against the blade such that the blade continues to be driven by the flywheel. When the top of the blade exits the nip, the idler wheel can move towards the flywheel and the toggle mechanism releases the idler wheel so that the nip is open. With the nip open and the downward movement of the blade halted by a lower bumper, the blade is permitted to be raised to its non-actuated position by a double torsion spring.

9 Claims, 5 Drawing Sheets 2
74
70
14
60
64
56
66
126
28
32
86
102
110
118
122
10
12
136
16
138
132
134
20
116
18
2

11
74
70
14
60
56
66
126
28
32
86
102
100
12
10
136
16
138
132
134
20
116
18
11

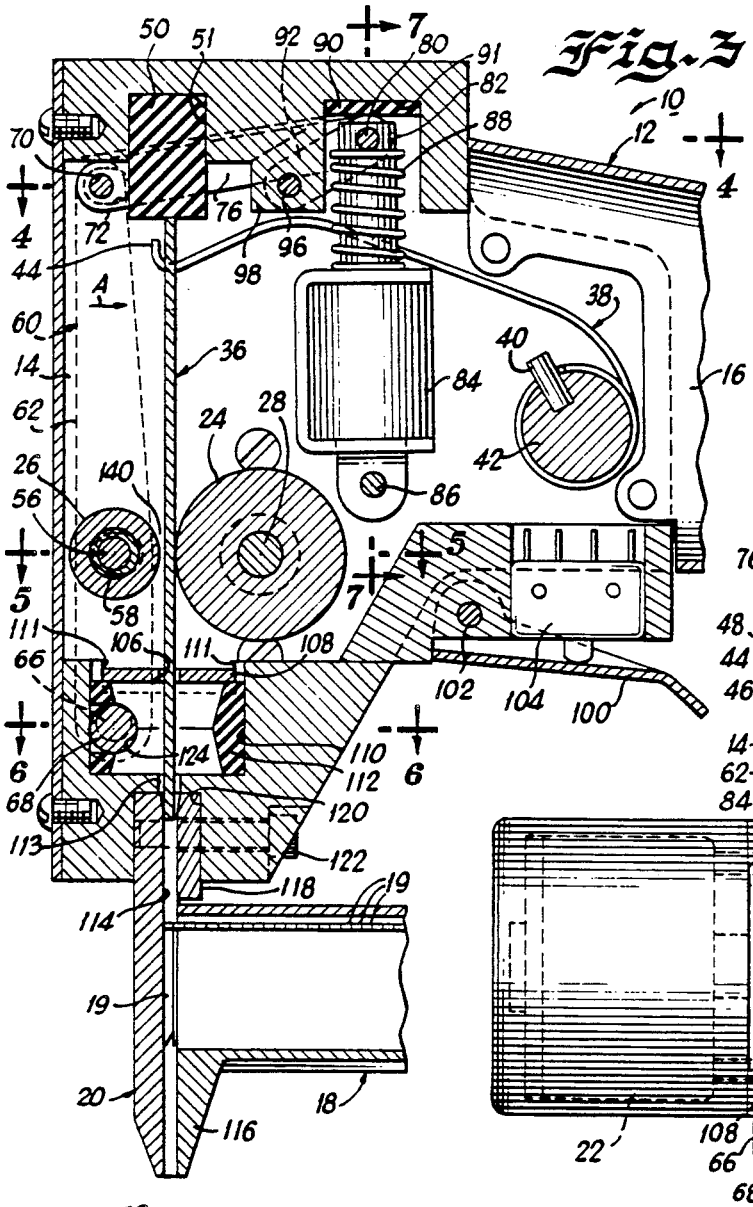
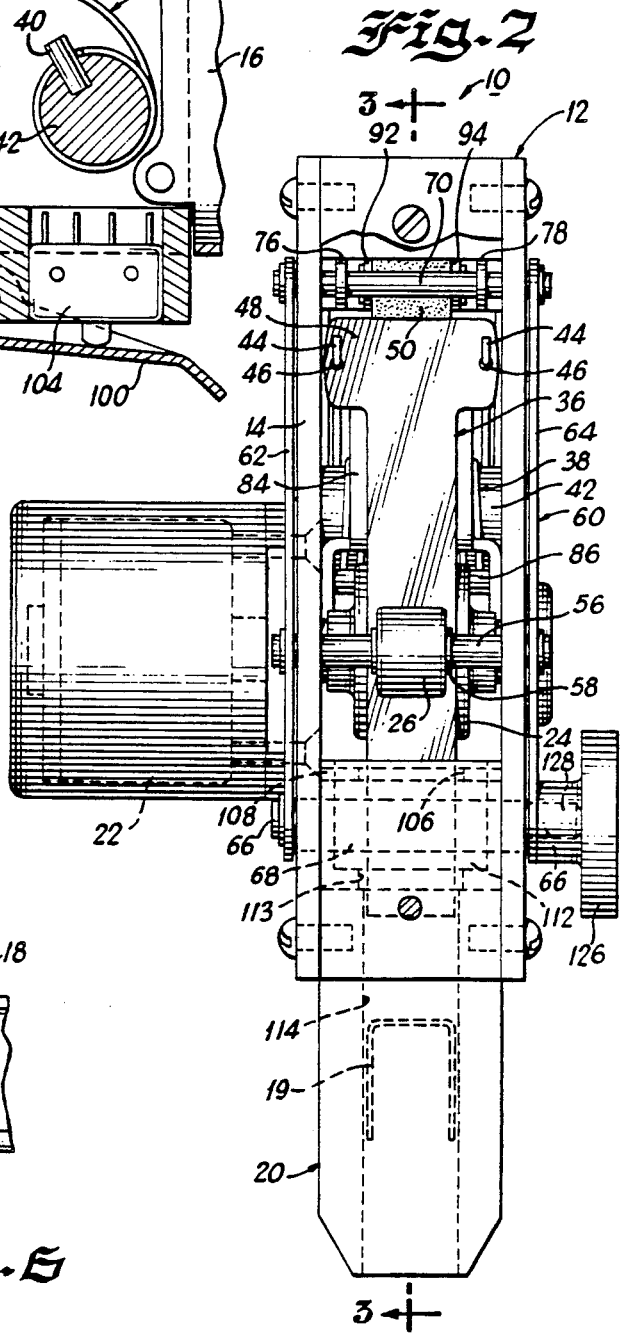
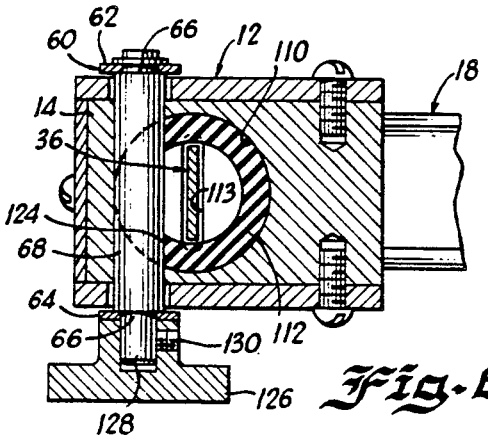
Fig. 5

10
70
156
148
154
152
84
12
72
76
144
4
150
82
88
86
62
14
60
28
142
166
140
168
170
26
56
52
58
16
164
180
178
102
104
100
66
68
176
19
114
158
20
18
116
19

ELECTRICAL POWER SOURCE
22
132
MTR.
141
104
84
SOL.
TIMING CIRCUIT 32
28
22
10
62
60
180
172
166
12
52
158
26
14
168
58
56
54
170
64
180
178
30
32
142
16
126

158
14
60
76
154
10
164
150
144
168
16
62
72
56
26
88
152
86
70
82
156
74
64
164
160
78
148
146
166
84
12
126

FASTENER DRIVING TOOL

CROSS REFERENCE TO RELATED APPLICATION

This application is a continuation-in-part of U.S. patent application Ser. No. 07/453,819, filed on Dec. 19, 1989 and assigned to the same assignee as the assignee of the present invention, now abandoned.

BACKGROUND OF THE INVENTION

1. Field of the Invention

This invention relates generally to fastener driving tools, and more particularly, to a new and improved fastener driving tool that utilizes an energy storing flywheel that is selectively engaged by a fastener driving member in order to drive the member into engagement with a fastener, such as a nail or a staple, for the purpose of driving the fastener into a workpiece.

2. Description of the Prior Art

Fastener driving tools have utilized an energy storing flywheel for the purpose of storing energy to drive a fastener into a workpiece. Examples of representative fastener driving tools of this type are disclosed in U.S. Pat. Nos. 4,121,745; 4,129,240; 4,189,080; 4,298,072; 4,323,127; 4,519,535; 4,544,090; 4,558,747 and 4,721,170. In addition, U.S. Pat. No. 4,928,868, the inventor and assignee of which are the same as in the case of the present invention, discloses a fastener driving tool wherein an energy storing flywheel cooperates with an idler wheel to selectively engage a ram for driving a fastener into a workpiece. These patents disclose an elastic cord and pulley arrangement to return the ram to its starting position. Such elastic cords, besides requiring a fairly complex supporting structure, require periodic replacement.

U.S. Pat. Nos. 4,042,036; 4,129,240; 4,161,272; 4,204,622 and 4,290,493 disclose other fastener driving tools having a return mechanism that includes a helical tension spring to return the ram to its starting position. In general, such an arrangement requires undesirable headroom for the contracted spring. In addition, tension springs, in accordance with Hooke's Law, exert linearly increasing resistance to the ram as it is driven during a driving stroke such that the force by which a fastener is driven into the workpiece may be negatively affected.

The rams or blades utilized by the tools disclosed in a number of prior art patents are relatively complex in that they require friction pads that are engaged by the flywheel to transmit energy to the ram (see for example, U.S. Pat. Nos. 4,042,036, 4,555,747 and 4,323,127 which show blades having friction pads that require assembly). Alternatively, some rams are formed with narrowed or thinned portions. When the narrowed portion is disposed adjacent the flywheel, the flywheel is not able to drive the ram thereby providing a way of disengaging the blade from the flywheel at the end of a drive stroke.

SUMMARY OF THE INVENTION

It is an object of the present invention to solve many of the problems associated with the prior art fastener driving tools.

It is another object of the present invention to provide a new and improved fastener driving tool having a simple and inexpensive return mechanism associated with a driver blade or ram.

It is also an object of the present invention to provide a new and improved flywheel type fastener driving tool which is both easily manufactured and inexpensive.

It is another object of the present invention to provide a new and improved flywheel type fastener driving tool that may have a self-contained power supply such as a battery.

It is a further object of the present invention to provide a new and improved fastener driving tool having a relatively inexpensive and easily manufactured fastener driving member.

It is another object of the present invention to provide a new and improved flywheel type fastener driving tool having a nip between the flywheel and an idler wheel which is easily and accurately adjustable in size.

It is still another object of the present invention to provide a new and improved fastener driving tool with a lever mechanism to force an idler wheel into engagement with a fastener driving member upon the actuation of a solenoid so that the fastener driving member is driven by a rotating flywheel and the idler wheel is maintained in that position after the solenoid has been deenergized until the fastener driving member has exited from a nip formed between the idler wheel and the flywheel.

In accordance with these and many other objects of the present invention, a fastener driving tool embodying the present invention includes a ram that is to be driven from a first or non-actuated position to a second or driving position. In order for the ram to be so driven, the fastener driving tool has a continuously rotating flywheel and an idler wheel positioned adjacent to the flywheel so as to define a nip between the flywheel and the idler wheel. The ram normally is disposed in the nip between the flywheel and idler wheel. The position of the idler wheel is movable relative to the flywheel to adjust the size of the nip from an open position when the ram is not forced against the flywheel to a closed ram engaging position when the ram is forced against the flywheel such that the ram is driven toward a fastener during a fastener driving stroke.

In order to initiate the fastener driving stroke, a trigger may be depressed such that a solenoid is actuated for a short period of time (this period of time should be at least less than the time it takes for the ram to travel from its non-actuated position to a position when it has exited the nip). The actuation of the solenoid retracts the armature of the solenoid that is coupled to a lever mechanism that moves the idler wheel towards the flywheel to thereby close the nip. As a result, the ram is forced against the flywheel and is propelled through the nip until the top of the ram exits the nip. Even after the solenoid has been deenergized and while a portion of the ram is still within the nip between the flywheel and the idler wheel, the lever mechanism maintains the solenoid armature retracted and the idler wheel forced against the ram notwithstanding the force applied to the retracted armature by a return spring associated with the solenoid.

Once the ram exits the nip, the force applied by the return spring against the solenoid armature overcomes the force applied against the armature by the lever mechanism because the idler wheel can move into the nip to thereby release the lever mechanism. With the return spring moving the armature to its normal position, the idler wheel is returned to its non-actuated position by the lever mechanism. The returning of the idler wheel to this non-actuated position opens the nip and the ram is allowed to be retracted to its non-actuated position by means of a double torsion spring.

BRIEF DESCRIPTION OF THE DRAWINGS

FIG. 2 is a front elevational view taken along line 2—2 of FIG. 1 showing the blade of the fastener driving tool in its retracted position;

FIG. 3 is a partially cut-away cross-sectional view taken along line 3—3 of FIG. 2;

FIG. 6 is a partially cut-away plan sectional view taken along line 6—6 of FIG. 3;

FIG. 8 is a partially cut-away cross-sectional view similar to FIG. 3 with the blade of the fastener driving tool shown in its driven position;

DETAILED DESCRIPTION OF THE PREFERRED EMBODIMENT

Figure 1:
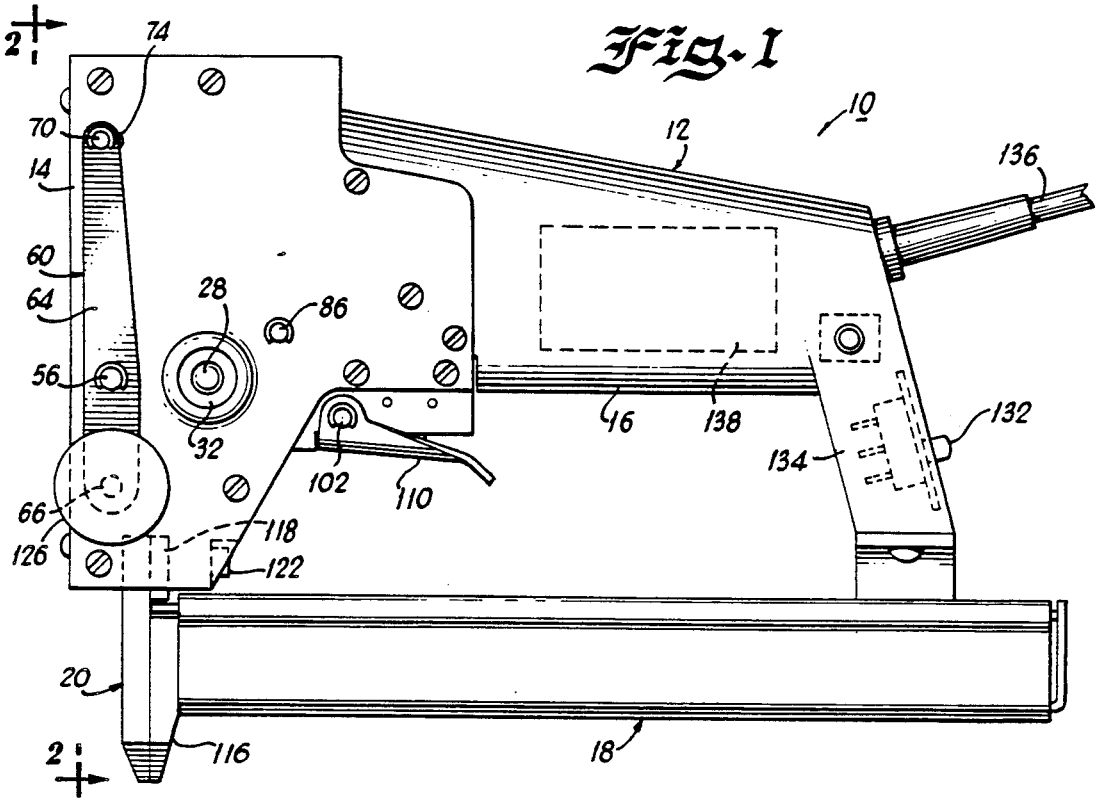
FIG. 1 is a side elevational view of one embodiment of the fastener driving tool according to the present invention.
Figure 10:
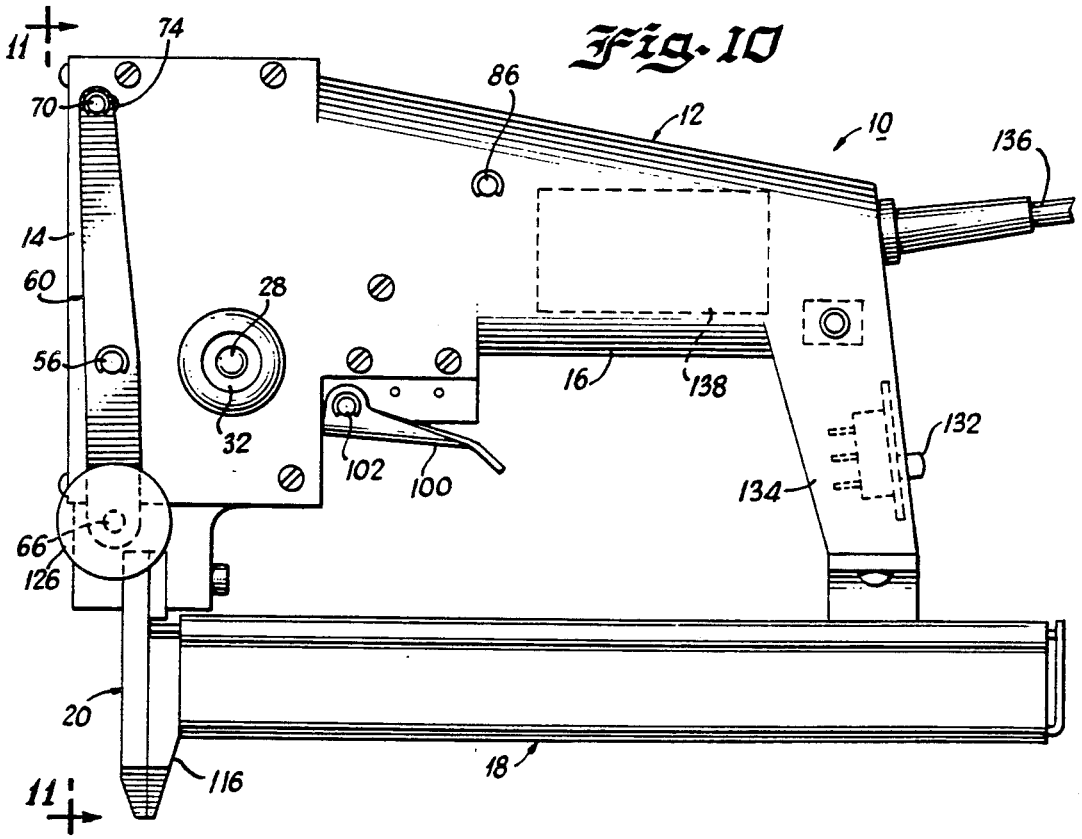
FIG. 10 is a side elevational view of a second embodiment of the fastener driving tool according to the present invention.

Referring now to the drawings and with particular attention to FIG. 1, there is shown a fastener driving tool according to the present invention and generally designated by the reference numeral 10. The fastener driving tool 10 illustrated in FIG. 1 includes a housing 12 having a vertical portion 14 and a handle portion 16. A magazine 18 is affixed to the housing 12 and contains the fasteners to be driven. Typically, the magazine 18 will automatically advance and position a fastener 19 in a driving position at the completion of each drive stroke. In the illustrated embodiment, the magazine 18 is designed to hold U-shaped staples, but other suitable magazines including those designed to hold nails or other fasteners may be used with appropriate modifications to the tool.

Figure 5:
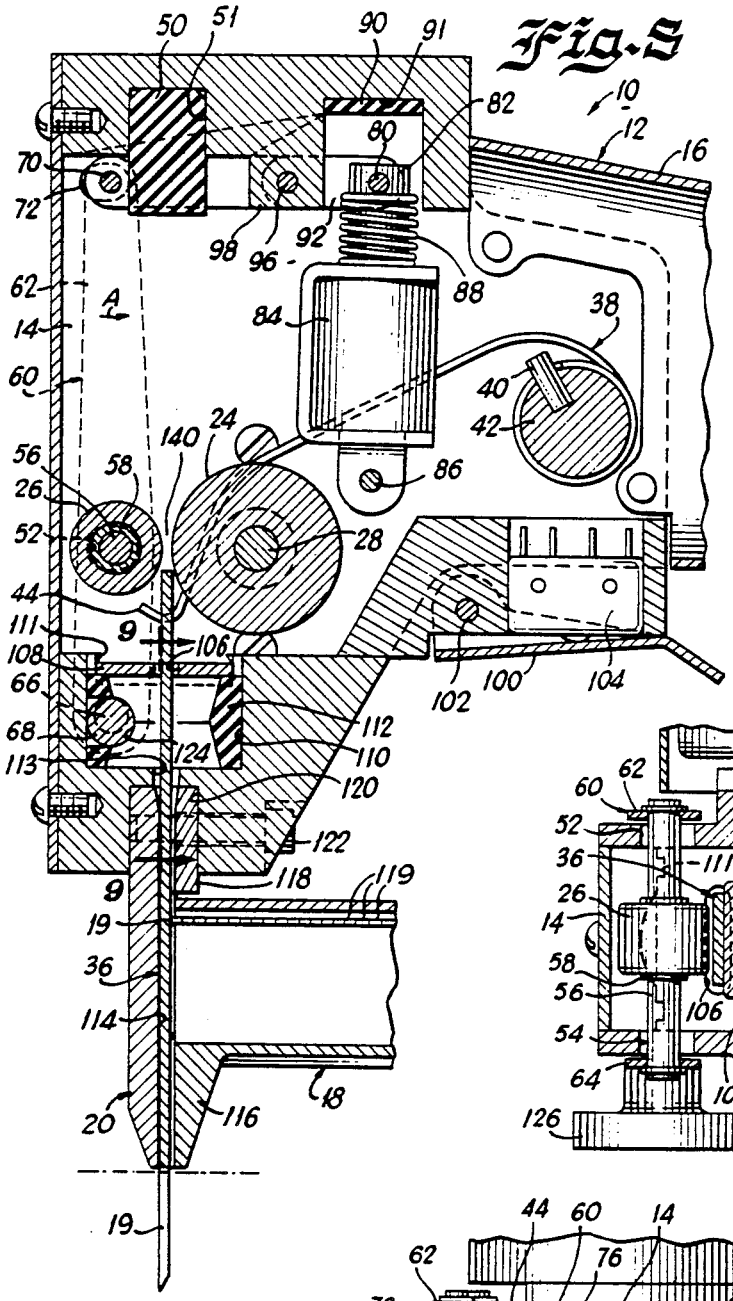
FIG. 5 is a partially cut-away plan sectional view taken along line 5—5 of FIG. 3.
Figure 7:
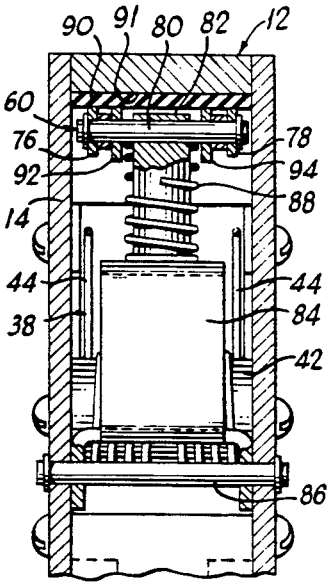
FIG. 7 is a partially cut-away cross-sectional view taken along line 7—7 of FIG. 3.
Figure 5:
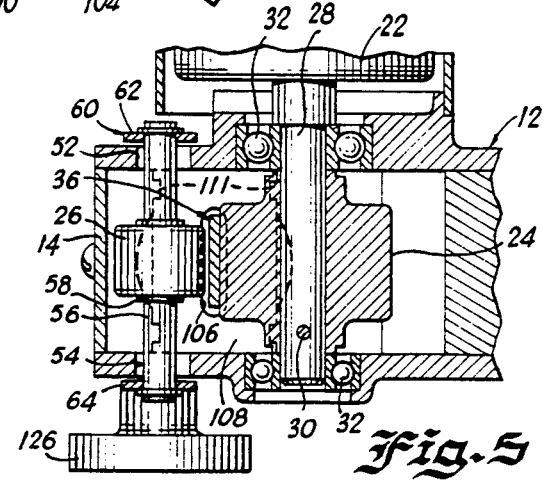
Figure 9:
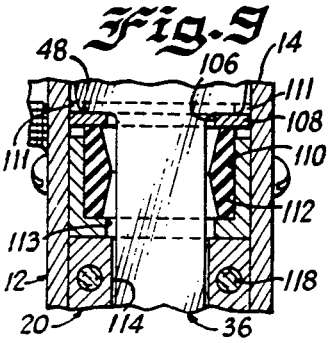
FIG. 9 is a partially cut-away cross-sectional view taken along line 9—9 of FIG. 8.

The fastener driving tool 10 includes a nose-piece 20, an electric motor 22, which may be powered either from an AC main source or a battery powered source, a flywheel 24 and an idler wheel 26. A shaft 28 (FIG. 5) serves as both the drive shaft of the motor 22 and the shaft of the flywheel 24. The shaft 28 serves to rotate the flywheel 24 by means of a pin 30 whenever the motor 22 is energized. The motor shaft 28 is supported within the housing 12 by bearings 32, which may be ball bearings, needle bearings or other suitable bearings.

A fastener driving member 36, which also may be referred to as a blade or ram, is formed of metal, for example, a relatively inexpensive metal such as S2 tool steel. The blade 36 is stamped and hardened and does not require any complex machining or assembly step in its manufacture. The blade 36 is supported within the vertical portion 14 of the housing 12 by a double torsion spring 38. The spring 38 is mounted in the housing 12 by means of a pin 40 on a drum 42 in the handle 16 of the tool 10. The center of the double torsion spring 38 is engaged by the pin 40, and the turns of the spring 38 are wrapped around the drum 42 in a counter-clockwise direction as shown in FIG. 3. The double torsion spring 38 has a pair of ends 44 each of which engages one of a pair of apertures 46 located on a T-shaped end 48 of the blade 36 (FIG. 2). The torsion spring 38 is tensioned to hold the T-shaped end 48 of the blade 36 in a first non-actuated or retracted position in contact with a cylindrical upper limiting bumper 50 (FIGS. 2 and 3). The amount of tension on the spring 38 is dependent on the diameter of the spring 38, the material of the spring 38, and the bend of the spring 38, all of which are preselected to exert a minimum upward force against the upper limiting bumper 50 when the blade 36 is in the first non-actuated position. This upward force will increase as the torsion spring 38 is pulled downwardly with the blade 36 during a driving stroke. The upper limiting bumper 50 is formed of a resilient material, such as, for example, rubber or neoprene or other similar material, and is located within a housing cavity 51 to act as a stop whenever the torsion spring 38 returns the blade 36 to the first or non-actuated position, as will be described hereinafter.

The idler wheel 26 is supported by a shaft 56 which is positioned within two slots 52 and 54 (FIG. 5) of the housing 12. A bearing 58, which may be a needle bearing or a bearing fabricated from any suitable material, permits the idler wheel 26 to rotate freely about the shaft 56. The idler wheel shaft 56 is movable laterally within the slots 52 and 54 by a toggle mechanism 60 that includes a pair of sidearms 62 and 64 that are located on the exterior of the housing 12 and support the shaft 56. The sidearms 62 and 64 are mounted on a pair of eccentric pivot axles 66 which are formed intergally with a shaft 68 mounted on the housing 12. The upper ends of the sidearms 62 and 64 are joined by a shaft 70 through slots 72 and 74 (FIG. 4) in the housing 12. The toggle mechanism 60 also includes a pair of actuator arms 76 and 78 pivotably mounted at a first end on the shaft 70 within the housing 12. The actuating arms 76 and 78 are pivotably mounted at their second end on a shaft 80 passing through an armature 82 of a solenoid 84 which is in turn pivotably mounted on the housing 12 by means of a shaft 86. When the solenoid 84 is not energized, a compression spring 88 maintains the armature 82 in contact with a resilient protective bumper 90 mounted in a cavity 91 of the housing 12.

Figure 4:
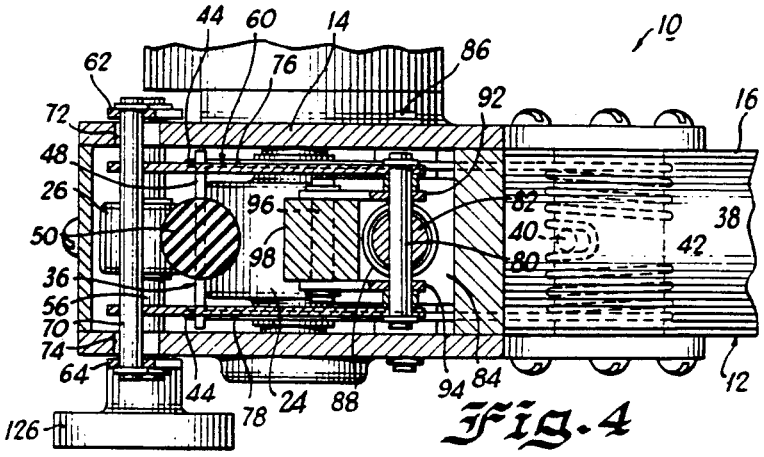
FIG. 4 is a partially cut-away plan sectional view taken along line 4—4 of FIG. 3.

The toggle mechanism 60 further includes a pair of pivot arms 92 and 94 (FIG. 4). One end of each of the pivot arms 92 and 94 is pivotably mounted on the shaft 80 and the other end is pivotably mounted on a shaft 96 passing through an extension 98 of the housing 12. A manually actuated trigger or push button 100 is mounted on a shaft 102 in the handle 16. The trigger 100 actuates a trigger switch 104 which in turn actuates the solenoid 84 through a timing circuit (for example, the timing circuit shown in FIG. 17).

The blade 36 passes between the flywheel 24 and the idler wheel 26 and thereafter through an aperture 106 in a removable, rectangular retainer 108 positioned at the upper end of a cavity 110 by a lower limiting bumper 112. The removable retainer 108 prevents the T-shaped end 48 of the blade 36 from directly engaging the lower bumper 112. The lower bumper 112 is held in place by the retainer 108 and lugs 111, and is formed of a resilient material such as rubber or neoprene. In the first non-actuated or retracted position, the blade 36 will continue through the cavity 110 into an aperture 113 in the housing 12. In this first position shown in FIG. 3, the lower end of the blade 36 terminates at the upper end of a drive path 114 formed between the nosepiece 20 and a forward portion 116 of the magazine 18. The alignment of blade 36 is controlled by the drive path 114. An upper portion 118 of the magazine 18 inserted within a chamber 120 of the housing 12 removably connects magazine 18 to the housing 12 by a fastener 122.

To insure optimum driving conditions for the engagement of the idler wheel 26 and the flywheel 24, a grooved portion 124 of the lower limiting bumper 112 is frictionally engaged with the shaft 68 to allow the pivot points of the eccentric pivot axles 66 of the toggle mechanism 60 to be adjusted by means of a knob 126. The knob 126 is mounted on an extension 128 of the pivot axles 66 by means of a pin 130 and allows the spacing between the idler wheel 26 and the flywheel 24 to be adjusted by revolving the pivot axles 66 about the shaft 68. This effectively moves the idler wheel 26 closer to or farther from the flywheel 24 and adjusts the size of a nip 140 formed between the idler wheel 26 and the flywheel 24.

Operation of the fastener driving tool 10 is controlled by an on/off switch 132 mounted on a portion 134 of the handle 16 which is also affixed in a conventional manner to the magazine 18. The switch 132 allows power to be supplied to the tool 10 from a power cord 136 or a battery 138, which may be located within the handle 16 or which may be external to the tool 10, for example, worn on a side of an operator. With the switch 132 in the "on" position, power is supplied to the electric motor 22 which then runs continuously. The blade 36 is in its first position shown in FIG. 3, but the rotation of flywheel 24 has no effect because the nip 140 formed between the flywheel 24 and the idler wheel 26 is held in its open position by the toggle mechanism 60 until the trigger 100 is actuated.

The actuation of the trigger 100 serves to apply power for a short period of time to the solenoid 84 and retract the armature 82. As the armature 82 is retracted, the movement of the pivot arms 92 and 94 forces the solenoid 84 to pivot about the shaft 86 from a substantially vertical alignment shown in FIG. 3 to an alignment angled from the vertical in a clockwise direction as shown in FIG. 8. As the pivot arms 92 and 94 force the shaft 80 away from the blade 36 in the direction indicated by an arrow A, the actuating arms 76 and 78 also are pulled in the same direction and the movement of the actuating arms 76 and 78 pulls the sidearms 62 and 64 with them. This movement of the sidearms 62 and 64 forces the idler wheel 26 into contact with the ram 36, thus closing the nip 140 formed between idler wheel 26 and the flywheel 24. The idler wheel 26 is held against the blade 36 with sufficient force that the rotation of flywheel 24 now forces the blade 36 through the nip 140 with a substantial mechanical advantage, down drive path 114 and into contact with a fastener 19, the force of the blade 36 then driving the fastener 19 into the workpiece. In order to insure that the idler wheel 26 applies a sufficient amount of force against the blade 36, the shaft 56 is made of a deflectable material.

Figure 17:
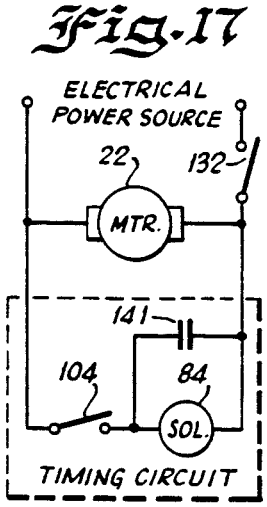
FIG. 17 is an example of a timing circuit that may be used in the fastener driving tool of the present invention.
Figure 14:
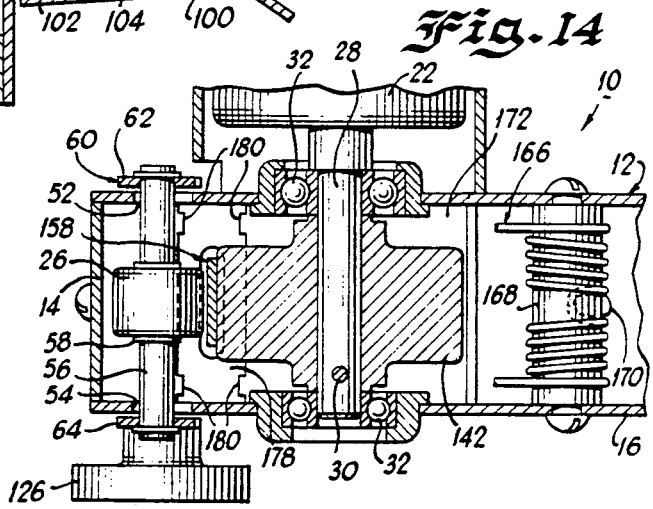
FIG. 14 is a partially cut-away plan sectional view taken along line 14—14 of FIG. 12.
Figure 13:
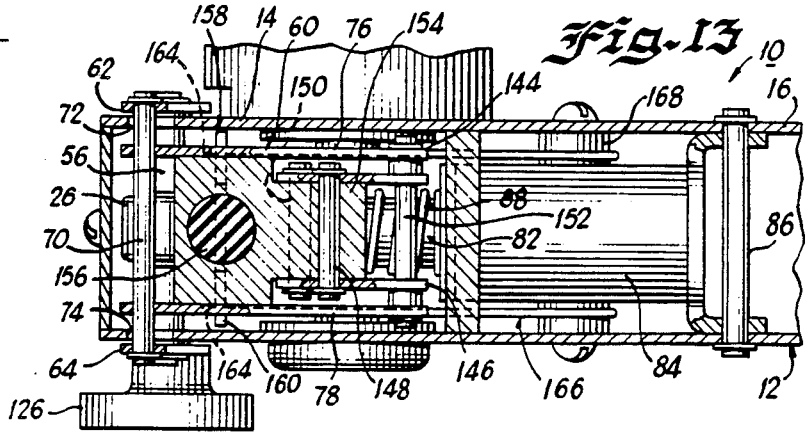
FIG. 13 is a partially cut-away plan sectional view taken along line 13—13 of FIG. 12.

Once the nip 140 is closed, a conventional timing circuit may be used to deenergize the solenoid 84 at least prior to the time when the ram 36 has cleared the nip 140 (for example, as shown in FIG. 8 of the drawings). Such a timing circuit could include a microchip which causes the solenoid 84 to remain in its energized state while the microchip counts clock interrupts until the requisite time period has elapsed. Once this requisite time period has elapsed, the solenoid is deenergized. An alternative timing circuit is shown in FIG. 17 wherein an appropriately selected capacitor 141 maintains power to the solenoid 84 for the requisite time for the armature 82 to be retracted and the idler wheel 26 to be moved into engagement with the ram 36. Alternatively, a monostable multivibrator may be used for a portion of the timing circuit.

When the timing circuit deenergizes the solenoid 84, the armature 82 of the solenoid 84 will be maintained in its actuated position as shown in FIG. 8 notwithstanding the fact that the compression spring 88 is applying a force on the solenoid armature 82 attempting to return it to the position shown in FIG. 3. However, the force applied to the armature 82 at the shaft 80 by the toggle mechanism 60 including the pivot arms 92 and 94, the actuating arms 72 and 74 and the side arms 62 and 64 due to the engagement of the idler wheel 26 against the ram 36 is sufficient to maintain the pivot arms 92 and 94, the actuating 72 and 74 and the side arms 62 and 64 locked in the position indicated in FIG. 8.

Once the blade 36 clears the nip 140 (as, for example, shown in FIG. 8), the force being exerted on the lever arms 62 and 64 as a result of the deflection of the shaft 56 due to the engagement of the idler wheel 26 against the blade 36 is released because the idler wheel 26 can move towards the flywheel 24 into the now vacated nip 140. With the release of the forces against the lever arms 62 and 64, the force exerted by the compression spring 88 is sufficient to move the armature 82 back to its static or normal position shown in FIG. 3 such that the solenoid 84 returns to its vertically aligned position shown in FIG. 3. As this occurs, the pivot arms 92 and 94, the actuating arms 76 and 78, and the side arms 62 and 64 also are returned to their static position shown in FIG. 3. As a result, the idler wheel 26 is moved away from the flywheel 24 to open the nip 140. With the nip 140 open and after the downward movement of the blade 36 has been stopped by the lower bumper 112, the double torsion spring 38 can return the blade 36 to its non-actuated position in contact with the upper limiting bumper 50 as shown in FIG. 3 because the clearance of the nip 140 between the idler wheel 26 and the flywheel 24 becomes greater than the thickness of the blade 36.

FIGS. 10 through 16 of the present application show an alternative embodiment of the present invention wherein a larger flywheel 142 replaces the flywheel 24 and other modifications necessary to accommodate the larger flywheel 142 have been made. As the design and operation of the embodiments shown in FIGS. 1–9 and FIGS. 10–16 are substantially similar, only the differences will be described. Similar reference numerals are used for each embodiment where the elements are substantially the same.

Figures 11, 12, 15:
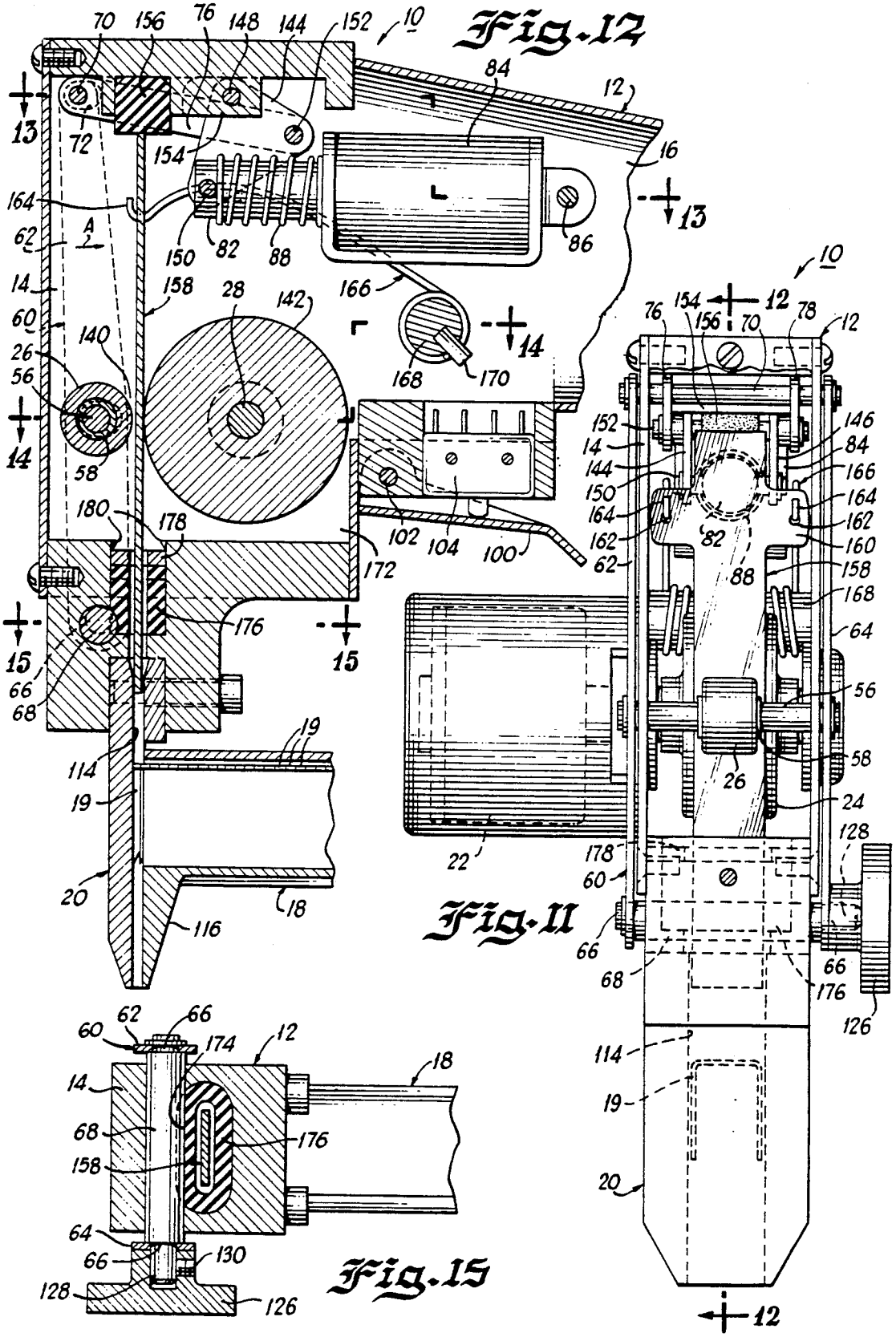
FIG. 11 is a front elevational view, partially broken away, of FIG. 10 taken along line 11—11 of FIG. 10 with the blade of the fastener driving tool shown in its retracted position.
FIG. 12 is a partially cut-away cross-sectional view taken along line 12—12 of FIG. 11.
FIG. 15 is a partially cut-away plan sectional view taken along line 15—15 of FIG. 12.

In the alternative embodiment of FIGS. 10–16, the solenoid 84 has been repositioned to make room for the larger flywheel 142. As shown in FIG. 12, the solenoid 84 is in a horizontal position instead of a vertical position shown in FIGS. 1–9. Nevertheless, the solenoid 84 operates essentially in the same manner. However, due to the fact that the solenoid armature 82 is now operating in a horizontal direction, a pair of triangular pivot plates 144 and 146 joined by three shafts 148, 150 and 152 replaces the pivot arms 92 and 94. The shaft 148 passes through a housing extension 154 and provides a fixed pivot point for the pivot plates 144 and 146. The shaft 150 passes through the armature 82 of the solenoid 84 and allows the solenoid 84 to move the toggle mechanism between the positions shown in FIG. 12 and FIG. 16. The shaft 152 provides a linkage between the actuating arms 76 and 78 and the pivot plates 144 and 146.

A driving blade 158 having a cross-shaped upper end 160 can be used with the fastener driving tool 10 shown in FIGS. 10–16. Each arm of the cross-shaped upper end 160 of the blade 158 has an aperture 162 through which a hooked end 164 of a double torsion spring 166 is engaged. A smaller upper limiting bumper 156 is provided so that there is sufficient clearance for the operation of the solenoid armature 82 and for the longer blade 158. The double torsion spring 166 is affixed to a drum 168 by means of pin 170, the drum 168 being attached to the housing 12 in a conventional manner. An expanded area 172 of the housing 12 is provided to give the flywheel 142 additional room.

As was the case with the embodiment disclosed in FIGS. 1–9, the shaft 68 is frictionally engaged within a groove 174 in a lower limiting bumper 176 to allow the knob 126 to adjust the toggle mechanism's pivot point and consequently, the size of the nip 140. The bumper 176 is held in place by a rectangular retaining plate 178 and lugs 180.

The operation of the embodiment disclosed in FIGS. 10–16 is similar to that of the embodiment disclosed in FIGS. 1–9. When the on/off switch 132 is in the "on" position, the flywheel 142 commences to rotate in a counterclockwise direction when viewed in the orientation shown in FIG. 12. However, the rotation of the flywheel 142 does not affect the position of the blade 158 until the nip 140 is closed.

When the trigger 100 is actuated, the solenoid 84 is energized for a short period of time and the solenoid armature 82 is retracted such that the shaft 150 is pulled with it. This causes the pivot plates 144, 146 to pivot about the shaft 148 and pull the sidearms 62 and 64 towards the solenoid 84 by means of the actuating arms 76 and 78. The idler wheel 26 is carried by the sidearms 62 and 64 and is therefore moved toward the flywheel 142 to thereby close the nip 140. When the nip 140 is closed, the idler wheel 26 forces the blade 158 against the flywheel 142 with sufficient force that the rotating flywheel 142 propels the blade 158 down the drive path 114 against the fastener 19 and the fastener 19 is driven into the workpiece.

Figure 16:
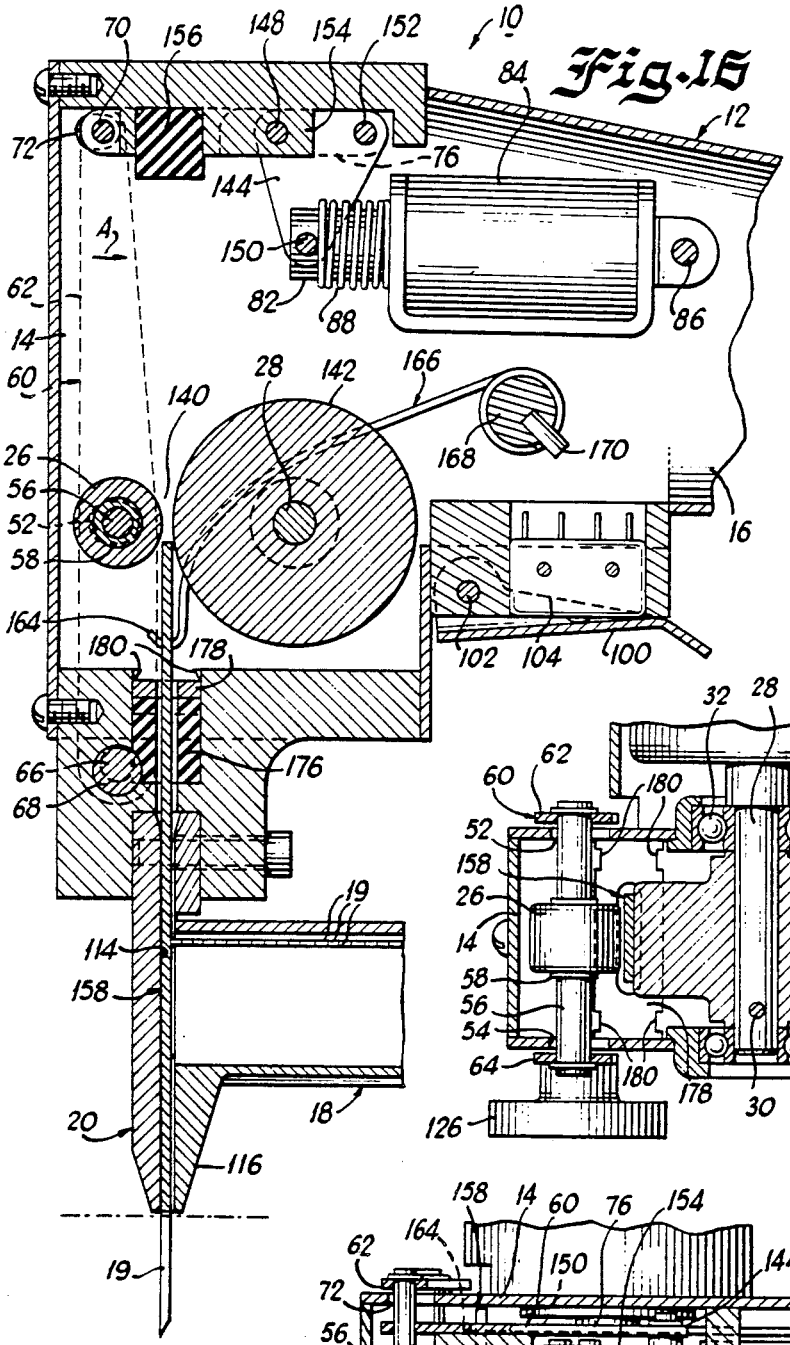
FIG. 16 is a cross-sectional view similar to FIG. 12 with the blade of the fastener driving tool shown in its driven position.

As previously discussed in connection with the embodiment shown in FIGS. 1–9, a conventional timing circuit may be used to deenergize the solenoid 84 after the nip 140 is closed. The solenoid 84 is deenergized at least prior to the time when the ram 158 has cleared the nip 140 (for example, as shown in FIG. 16 of the drawings). When the timing circuit deenergizes the solenoid 84, the armature 82 of the solenoid 84 will be maintained in its actuated position as shown in FIG. 16 notwithstanding the fact that the compression spring 88 is applying a force on the solenoid armature 82 attempting to return it to the position shown in FIG. 12. However, the force applied to the armature 82 at the shaft 150 by the toggle mechanism including the pivot plates 144 and 146, the actuating arms 72 and 74 and the side arms 62 and 64 due to the engagement of the idler wheel 26 against the ram 158 is sufficient to maintain the pivot plates 144 and 146, the actuating 72 and 74 and the side arms 62 and 64 locked in the position indicated in FIG. 16.

Once the blade 158 clears the nip 140 (as, for example, shown in FIG. 16), the force being exerted on the lever arms 62 and 64 as a result of the deflection of the shaft 56 due to the engagement of the idler wheel 26 against the blade 158 is released because the idler wheel 26 can move towards the flywheel 24 into the now vacated nip 140. With the release of the forces against the lever arms 62 and 64, the force exerted by the compression spring 88 is sufficient to move the armature 82 back to its static or normal position shown in FIG. 12 such that the solenoid 84 returns to its horizontally aligned position shown in FIG. 12. As this occurs, the pivot plates 144 and 146, the actuating arms 76 and 78, and the side arms 62 and 64 also are returned to their static position shown in FIG. 12. As a result, the idler wheel 26 is moved away from the flywheel 142 to open the nip 140. With the nip 140 open and after the downward movement of the blade 36 has been stopped by the lower bumper 112, the double torsion spring 166 can return the blade 158 to its non-actuated position in contact with the upper limiting bumper 156 as shown in FIG. 12 because the clearance of the nip 140 between the idler wheel 26 and the flywheel 142 becomes greater than the thickness of the blade 158.

While there have been described what are at present considered to be the preferred embodiments of the present invention, it will be understood that various modifications may be made therein which are within the true spirit and scope of the invention.

What is claimed as new and desired to be secured by Letters Patent of the United States is:

1. A fastener driving tool for driving a fastener into a workpiece comprising:

a flywheel;

driving means for driving said flywheel;

an idler wheel disposed adjacent to said flywheel and defining a nip therebetween;

a ram disposed in said nip between said flywheel and said idler wheel, said ram having a top end and a fastener engaging end and movable in a drive stroke from a non-actuated position to a fastener driving position;

altering means for altering the relative positions of said flywheel and said idler wheel to adjust the size of said nip from an open state to a closed ram engaging state; and initiating means for initiating the operation of said altering means to cause said altering means to adjust the size of said nip to said closed state, said initiating means including an electrically operated solenoid and timing means for energizing said solenoid for a predetermined time period that is less than the time it takes for said top end of said ram to travel from its non-actuated position to a position wherein said top end of said ram exits said nip so as to initiate the operation of said altering means to cause said ram to be driven due to the forcing by said idler wheel of said ram against said flywheel, said altering means maintaining the position of said idler wheel with respect to said flywheel such that said ram is propelled through said nip and said fastener engaging end engages said fastener to drive said fastener into said workpiece until said top end of said ram exits said nip at which time said altering means returns said nip to its open state.

2. The fastener driving tool of claim 1 including return means comprising a torsion spring for retuning said ram to its non-actuated position.

3. The fastener driving tool ŏf claim 2 wherein said torsion spring is a double torsion spring.

4. The fastener driving tool of claim 1 wherein the altering means includes a pivot point and adjusting means to adjust the position of said pivot point to thereby adjust the size of said nip.

5. The fastener driving tool of claim 1 wherein said fastener driving tool includes an internal power supply.

6. A fastener driving tool for driving a fastener into a workpiece comprising:

a flywheel;

driving means for driving said flywheel;

an idler wheel disposed adjacent to said flywheel and defining a nip therebetween;

a ram disposed in said nip between said flywheel and said idler wheel, said ram having a top end and a fastener engaging end and movable in a drive stroke from a non-actuated position to a fastener driving position;

altering means for altering the relative positions of said flywheel and said idler wheel to adjust the size of said nip from an open state to a closed ram engaging state, said altering means including a pair of side arms rotatably supporting said idler wheel, said side warms pivoting at a first end around an eccentric pivot point which is secured by frictional engagement with a lower bumper mounted within said fastener driving tool; and initiating means for initiating the operation of said altering means to cause said altering means to adjust the size of said nip to said closed state, said altering means maintaining the position of said idler wheel with respect to said flywheel such that said ram is propelled through said nip and said fastener engaging end engages said fastener to drive said fastener into said workpiece until said top end of said ram exits said nip at which time said altering means returns said nip to its open state.

7. A fastener driving tool for driving a fastener into a workpiece comprising:

a flywheel;

driving means for driving said flywheel;

an idler wheel disposed adjacent to said flywheel and defining a nip therebetween;

a driving blade disposed in said nip between said flywheel and said idler wheel, said driving blade being adapted to be driving in a driving stroke in order to drive said fastener into said workpiece;

adjusting means for adjusting the relative positions of said flywheel and said idler wheel to adjust the size of said nip from an open state to a closed driving blade engaging state; and electrically operated solenoid and timing means for energizing said solenoid for a predetermined time period which time period is less than the time it takes for said driving blade to be propelled through said nip and during which time period said adjusting means maintains the position of said idler wheel with respect to said flywheel so that said nip is in said closed state, said adjusting means maintaining said nip in said closed state such that said driving blade is propelled through said nip so as to drive said fastener into said workpiece until said driving blade exits said nip at which time said adjusting means returns said nip to its open state.

8. The fastener driving tool of claim 7 including return means comprising a torsion spring for returning said driving blade to its non-actuated position.

9. The fastener driving tool of claim 8 wherein said torsion spring is a double torsion spring.

* * * * *